United States Patent [19]

Ernst

[11] 4,084,957

[45] Apr. 18, 1978

[54] PROCESS FOR PRODUCING SHAPED BODIES

[75] Inventor: Heinz-Hubert Ernst, Frankfurt am Main, Germany

[73] Assignee: Metallgesellschaft Aktiengesellschaft, Frankfurt am Main, Germany

[21] Appl. No.: 615,965

[22] Filed: Sep. 23, 1975

[30] Foreign Application Priority Data

Sep. 24, 1974 Germany ..... 2445511

[51] Int. Cl.[2] ..... C22B 1/24

[52] U.S. Cl. ..... 75/3

[58] Field of Search ..... 75/3–5

[56] References Cited

U.S. PATENT DOCUMENTS

| | | | |
|---|---|---|---|
| 2,195,866 | 4/1940 | Clarick | 75/25 |
| 2,373,244 | 4/1945 | Holz | 75/25 |
| 2,631,178 | 3/1953 | Morton | 75/25 |
| 4,004,918 | 1/1977 | Fukuoka | 75/25 |

*Primary Examiner*—P. D. Rosenberg

*Attorney, Agent, or Firm*—Burgess, Dinklage & Sprung

[57] ABSTRACT

Shaped bodies are produced from mixed dust containing substantially iron oxide. The dusts are dry or moist or become available in the form of mud and at least one of these has or assumes thixotropic properties. The mixed dusts are treated to form a flowable, particulate mass by subjecting same to an impact- or a beatmilling action with an average moisture content that corresponds to the desired final moisture content. The particulate mass having been subjected to the milling action is then subsequently shaped in the usual fashion.

3 Claims, 2 Drawing Figures

PROCESS FOR PRODUCING SHAPED BODIES

BACKGROUND

This invention relates to a process of producing shaped bodies from mixed dusts, which contain substantially iron oxide and are dry or moist or become available in the form of mud and at least one of which has or assumes thixotropic properties.

When gases are purified in industrial plants, the separated substances become available as dry dust or mud or filter cake, in dependence on the purifying method which is used. These waste materials may vary greatly in physical properties even though they often have identical constituents, which may well be utilized further.

A typical example is the solids which are separated in the purification of gases in blast furnace and steel-making plants in the iron and steel industries. These solids contain iron, zinc, and lead and may become available as dry dust or as mud.

When these materials are to be processed further for a recovery of their metal content by a thermal treatment, it is necessary in most cases to shape the materials into bodies, e.g., by pelletizing, sintering or briquetting. Besides, it is desirable to jointly process those materials which become available in different plants and contain the same useful components. For this purpose, these materials must be mixed with each other before they are shaped into bodies because a starting material of uniform composition is desired for the further processing.

The mixing operation will not involve serious problems if the components in question are available in a dry state or in the form of mud. In the latter case, they may be jointly filtered to produce a homogeneous mixture. In some cases it may be suitable to filter both materials separately and then to feed them at metered rates to the subsequent process steps. This practice will be desirable if the individual components vary in rate and properties.

In most cases, however, it is desired to mix dusts and muds and the material discharged from filter presses and drums. The previous practice has been to dry the materials, to comminute the dry materials, and to homogenize the comminuted materials.

The mixing of moist dusts with each other and the mixing of dry and moist dusts and of muds sometimes involves considerable difficulties, particularly if one of the dusts tends to be thixotropic. The conventional mixing units, such as edge runner mixers, screw mixers, double shaft mixers, etc. are not satisfactory in such cases. The mixture has a pulplike, slimy consistency and further processing thereof is virtually impossible. The drying of such mixtures and of non-thixotropic dusts often results in a lumpy material, which must be subsequently ground and then be remoistened before or during the shaping step. This procedure is very complicated and uneconomical.

SUMMARY

This invention avoids the disadvantages of the previous procedure and particularly avoids the drying, grinding, and subsequent remoistening in the manufacture of shaped bodies and provides a simple procedure which, even where dusts are used which tend to be thixotropic, results in a homogeneous, flowable particulate mass which is suitable as a starting material for the manufacture of shaped bodies.

This is accomplished according to the invention in that the dusts are subjected to an impact- or a beatmilling action with an average moisture content which corresponds to the desired final moisture content and subsequently shaping the particulate mass after having been subjected to the milling action.

BRIEF DESCRIPTION OF DRAWINGS

The invention will be further described in the examples hereinbelow with reference to the accompanying drawings wherein.

DESCRIPTION

Figure 1:
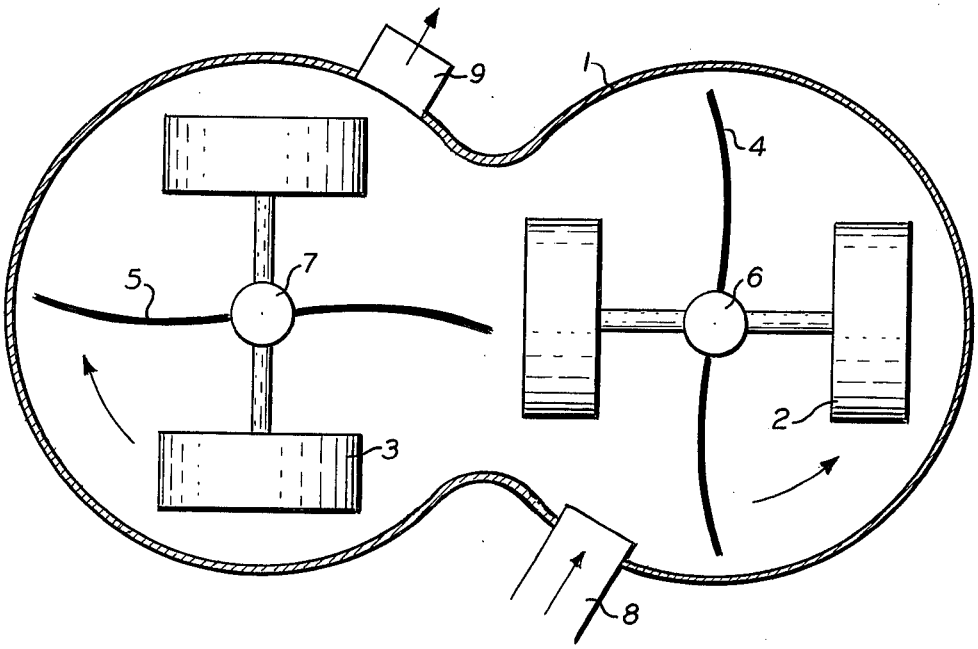
FIG. 1. PRIOR ART
FIG. 1 is a schematic sectional view through a runner mixer apparatus which is not suitable for practicing the present invention.
Figure 2:
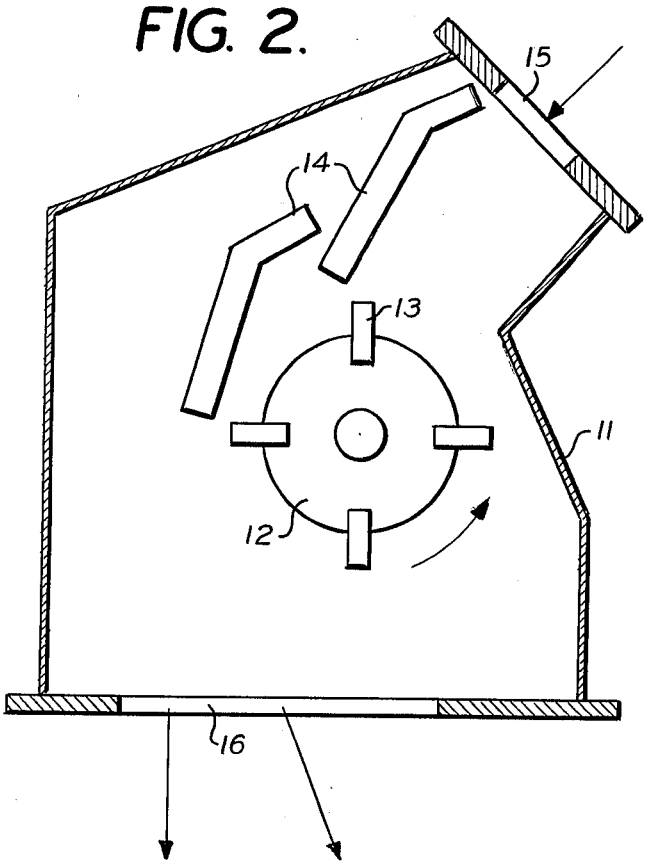
FIG. 2 is a schematic sectional view through an impact mill used to practice the present invention successfully.

It has been found that dry or moist dusts or dusts which become available in the form of mud, which dusts contain components that tend to be thixotropic, can be mixed in such a manner that the above-described disadvantages are avoided if the average moisture content of the dusts corresponds to the required final moisture content of the mixture to be shaped and these dusts are fed at metered rates to an impact mill or beater mill. In this case the material discharged by the impact mill or beater mill is a flowable solids product which has the moisture content desired for the shaping step. A certain additional moistening can be made in order to control the optimum moisture content for the shaping step.

According to a preferred feature of the invention the dust which has or assumes thixotropic properties is fed with a moisture content which is as low as possible. This low moisture content can be achieved by partial drying.

Because the dusts to be mixed pass through the mill within a short time, those properties of the dusts which result in thixotropy surprisingly remain ineffective. The product discharged from the mill is friable and flowable and is immediately shaped by one of the known processes.

According to another preferred feature of the invention, dust from oxygen top-blowing processes (LD processes) and dust collected from blast furnace top gases are fed.

The first is subjected to the milling action with a moisture content of at most 16 percent by weight, the latter of at most 40 percent by weight.

Mills for use with the process of the invention are furnished by Ahlmann und Beckschulte, Masch. Fabrik Bergneustadt, Bez. Köln; Händle Mühlacker and Hazemag, Münster.

The invention will now be described more in detail and by way of example.

EXAMPLE 1 (comparison example)

In a first experiment, blast furnace top gas mud having a moisture content of 41% was mixed in a continuously operated double edge runner mixer with an equal amount of dry dust recovered from an oxygen top-blowing process. The edge runner mixer comprises a double casing 1. The casing contains two edge runners 2 and 3 and two plugs 4 and 5 mounted on wheels 6 and 7 agitated by a common drive (not shown). The charge point and the discharge point are marked by 8 and 9. The resulting mixture was non-homogeneous and constituted a thixotropic pulp. In this condition the mixture could not be pelletized or forcibly shaped. Sticking and deposition in the mixing unit prevented a continuous mixing operation. The same observations have been made where conventional mixing units were used, such as a screw mixer and a double shaft mixer.

A mixing of the two dusts mentioned was possible when the blast furnace top gas mud had been dried to reduce its moisture content from 41% to 12%. Because the resulting mixture was lumpy, it had to be ground for homogenization. For instance, when the mixture was to be shaped by being pelletized, the final moisture content had to be increased to about 20% by an addition of water during the pelletizing step.

EXAMPLE 2

To carry out the process according to the invention, blast furnace top gas mud having a moisture content of 40% and an equal amount of dry dust recovered from the oxygen top-blowing process and having a moisture content of about 1% were fed to an impact mill. This impact mill consisted essentially of a housing 2, in which a rotor 12 provided with beater rods 13 was horizontally mounted and rotated at high speed. Two baffle plates 14 were installed in the housing space at the periphery thereof. The material is charged at 15 and discharged at 16.

The rotor was rotated at a circumferential speed of 30–35 m/sec. In a single pass, a friable, homogeneous flowable particulate mass was produced, which could be subsequently pelletized without difficulty. The average moisture content corresponded to the final moisture content and amounted to 20.5%.

EXAMPLE 3

The procedure was the same as in Example 2. Blast furnace top gas mud and dry dust recovered from the oxygen top-blowing process were fed to the impact mill in proportions of 70:30. The impact mill was of the same design as the mill of Example 2. The blast furnace top gas mud had a moisture content of 40%. The average moisture of the blast furnace top gas mud and dust from the oxygen top-blowing process amounted to 28%. In this case too, a friable, homogeneous flowable particulate mass was discharged from the mixer.

The process according to the invention (Examples 2 and 3) makes it possible to eliminate the drying step, an additional comminuting step, and a remoistening step (Example 1). The particulate masses produced in Examples 2 and 3 did not exhibit thixotropic properties.

The process permits of a trouble-free processing of dusts from gas-purifying plants which succeed blast furnaces, oxygen top-blowing converters, electric furnaces, open-hearth furnaces as well as from sintering plants, pelletizing plants, and of calcine from roasting furnaces.

What is claimed is:

1. A process for producing shaped bodies from mixed iron oxide dusts, at least one of which is in moist or mud form and at least one of which has thixotropic properties, which comprises beating such dusts in the presence of a total amount of moisture corresponding to the desired final moisture content, in an impact mill or beater mill thereby to form a flowable particulate mass, and forming the mass into shaped bodies.

2. Process of claim 1 wherein the dust which has or assumes thixotropic properties is fed with a moisture content as low as possible.

3. Process of claim 1 wherein the dust is recovered from an oxygen top-blowing process (LD process) and is subjected to the milling action with a moisture content of at most 16 percent by weight and in the form of mud produced by the purification of blast furnace top gas and is subjected to the milling action with a moisture content of at most 40 percent by weight.

* * * * *